United States Patent [19]

Kurihara et al.

[11] Patent Number: 4,760,048

[45] Date of Patent: Jul. 26, 1988

[54] MULTICOLOR HEAT-SENSITIVE RECORDING MATERIAL

[75] Inventors: Nobuhiro Kurihara; Sumitaka Tatsuta; Jun Yamaguchi; Toshimasa Usami, all of Shizuoka, Japan

[73] Assignee: Fuji Photo Film Co., Ltd., Kanagawa, Japan

[21] Appl. No.: 834,681

[22] Filed: Feb. 28, 1986

[30] Foreign Application Priority Data

Mar. 1, 1985 [JP] Japan ..... 60-40872
Apr. 22, 1985 [JP] Japan ..... 60-85904

[51] Int. Cl.[4] ..... B41M 5/18

[52] U.S. Cl. ..... 503/204; 427/150; 427/151; 428/341; 428/342; 428/913; 430/138; 430/142; 430/151; 430/171; 503/205; 503/215; 503/226

[58] Field of Search ..... 346/204, 205, 206, 226, 346/215; 427/150–152; 428/341, 342, 913; 430/138, 142, 151, 171; 503/204–206, 215, 226

[56] References Cited

FOREIGN PATENT DOCUMENTS

| | | | |
|---|---|---|---|
| 0185186 | 11/1982 | Japan | 346/215 |
| 0045090 | 3/1983 | Japan | 346/204 |
| 0045084 | 3/1983 | Japan | 346/204 |
| 58-55287 | 4/1983 | Japan | 346/204 |
| 0083842 | 5/1983 | Japan | 346/204 |

*Primary Examiner*—Bruce H. Hess
*Attorney, Agent, or Firm*—Sughrue, Mion, Zinn, Macpeak and Seas

[57] ABSTRACT

A multicolor heat-sensitive recording material is disclosed, comprising a support having carried thereon at least two colorless or light-colored color formers capable of developing different colors and color developers capable of reacting with said color formers upon heating to develop colors, wherein at least one of the color formers and color developers is encapsulized, at least one of the color formers is a diazo compound which is substantially decomposed by light, and at least one of the other color formers is a compound which is not substantially decomposed by light. The material provide a multicolor image having excellent hues and sharpness without color smearing and is free from undesired color formation before or after recording.

21 Claims, No Drawings

MULTICOLOR HEAT-SENSITIVE RECORDING MATERIAL

FIELD OF THE INVENTION

This invention relates to a multicolor heat-sensitive recording material, and particularly to a heat-sensitive recording material comprising a support having carried thereon at least two colorless or light-colored color formers capable of developing different hues and color developers capable of reacting with such color formers upon application of heat to develop colors.

BACKGROUND OF THE INVENTION

Rapid development of the information industry has increased demand for easily obtaining color hard copies from terminals of information devices, such as electronic computers, facsimile machines, and the like.

Attempts to fulfill this demand include an ink jet system and a heat-sensitive transfer system. However, the ink jet system comprising jetting an ink containing a color material from a narrow nozzle involve a serious disadvantage of poor recording reliability due to a tendency toward obstruction of the nozzle by the color material or other additives. The heat-sensitive transfer system compirses imagewise dissolving an ink on an ink sheet by heating and transferring the dissolved ink to paper. Therefore, formation of a multicolor image uneconomically requires a number of ink sheets, for example, 4 ink sheets for a four-color image. Further, care should always be taken not to suffer an ink shortage in the former system, or not to suffer a shortage of the ink sheets in the latter system. In other words, both of the above systems require complicated control by users.

On the other hand, a heat-sensitive color development system is known as a process with respect to which such complicated control is of no necessity and high recording reliability can be ensured and has, therefore, been rapidly spread in the field of black-and-white facsimiles or printers. This system is characterized by a recording material comprising a support having provided thereon a layer having a color formation function. Because of its easiness with which to record, application of the heat-sensitive color development system to multicolor formation has keenly been demanded.

However, in order to establish multicolor formation taking advantage of the heat-sensitive color development system, it is necessary to integrate a plurality of color formation functions corresponding to the desired number of colors on the same support and to make each of the functions work under control. Many attempts have hitherto been made to effect this idea, but none of them realized sufficient color formation control.

For example, recording materials proposed for multicolor formation include the one in which two color formers capable of developing different colors at different temperatures are used as an admixture in the same heat-sensitive color forming layer, as is disclosed in Japanese Patent Publication No. 69/74, and one in which a color forming layer capable of forming a color at a higher temperature (high-temperature sensitive color forming layer) and a color forming layer capable of forming a color at a lower temperature (low-temperature sensitive color forming layer) are separately laminated on a support, as is disclosed in Japanese Patent Publication Nos. 11989/76 and 133991/77 and Japanese Patent Application (OPI) Nos. 88135/79, 133991/80, 133992/80 and 15540/73. A recording material has also been described further including a decoloring agent, in addition to the above-described high- and low-temperature sensitive color forming layers, said decoloring agent exerting its effect over the color forming components in the low-temperature sensitive color forming layer in the areas corresponding to the image areas of the high-temperature sensitive color forming layer during color formation in the high-temperature sensitive layer, as is described in Japanese Patent Publication Nos. 17866/75, 5791/76 and 14318/82 and Japanese Patent Application (OPI) No. 16188/80.

Further, Japanese Patent Application (OPI) No. 55287/83 discloses a two-color recording material, in which an aqueous solid dispersion containing a leuco dye, an acidic substance capable of causing the leuco dye to develop a color upon heating, a diazo compound, and a coupling component capable of causing the diazo compound to develop a color upon heating is coated on a support and dried to form a heat-senstive recording layer that can develop two colors through heat recording followed by decomposition of the diazo compound by irradiation of light followed by heat recording.

Nevertheless, each of these conventional multicolor heat-sensitive recording materials has its respective drawbacks, and fails in attaining fully satisfactory results.

For instance, in the cases where a recording material comprising a support having provided thereon one or two heat-sensitive color forming layer or layers is recorded at a low temperature and a high temperature to form a low-temperature developed image and a high-temperature developed image that are different in color, respectively, the color of the high-temperature developed image is mixed with that of the low-temperature developed image to a degree varying depending on recording conditions, such as temperature, humidity, recording machines, and the like. Accordingly, it is difficult to constantly obtain images of stable color tone. In addition, when high-temperature recording is effected, there are produced low-temperature zones having the same temperature as employed for low-temperature recording at the periphery of the areas to which a high temperature is applied. Generation of such low-temperature zones around the high-temperature recorded image, the so-called shading or smearing phenomenon, casuses loss of image sharpness.

Although the recording material having a decoloration function prevents color mixing, the problem of color smearing still remains unsolved. Moreover, incorporation of the decoloring agent in the recorded layer causes additional disadvantages, such as color disappearance of an image, reduction in sensitivity of unrecorded materials, and the like, when the recording or recorded materials are left to stand in a high temperature and high humidity atmosphere.

In the recording material containing in the same layer a leuco dye, an acidic color developer, a diazo compound and a coupling component in the form of solid dispersions, the dispersions of these components, though indepedent of each other as water-insoluble dispersions, are inevitably brought into contact with each other within the recording layer, to thereby undergo color formation reactions in the contact phase. As a result, the so-called background fog becomes significant and, in particular, working preservability of unrecorded materials under high temperature and high humidity conditions becomes extremely poor. Additionally, the color formation reaction between the diazo compound and the coupling component, that would smoothly proceed in a basic atmosphere, does not smoothly proceed due to the presence of the acidic color developer for the leuco dye in the same layer, thus resulting in images inferior in sensitivity and hue.

SUMMARY OF THE INVENTION

Accordingly, an object of this invention is to provide a multicolor heat-sensitive recording material which can produce a multicolor image having sufficiently controlled different hues and sharpness without color smearing.

Another object of this invention is to provide a multicolor heat-sensitive recording material which is free from undesired color formation before recording during preservation and which produces images exhibiting good stability and preservability.

These objects can be accomplished by a multicolor heat-sensitive recording material comprising a support having carried thereon at least two colorless or light-colored color formers capable of developing different colors and color developers capable of reacting with said color formers upon heating to develop colors, wherein at least one of the color formers and color developers is encapsulized, at least one of the color formers is a diazo compound capable of being substantially decomposed by light, and at least one of the other color formers is incapable of being substantially decomposed by light.

DETAILED DESCRIPTION OF THE INVENTION

A basic example of the color formation system according to the present invention will hereinafter be described.

In cases where a diazo compound and a color former other than the diazo compound are separately encapsulized, application of heat to the material melts a coupling component and, at the same time, softens the wall of the diazo compound-containing microcapsules to thereby increase permeability of the wall. Through the thus softened microcapsule wall, the molten coupling component enters into the capsules and reacts therein with the diazo compound to develop a certain hue. Likewise, the color former other than the diazo compound within other microcapsules is brought into contact with another color developer to develop a different hue. As a result, a single hue composed of both hues thus developed can be obtained. Then, the recording material is irradiated with light having a specific wavelength corresponding to the photolytic wavelength of the aforesaid diazo compound and, thereafter, heat is applied to areas other than those heated before, Since the diazo compound has been decomposed with light, it does not undergo a color formation reaction by this further heat application, but rather the reaction between the color former other than the diazo compound and the color developer therefor takes place to develop a color. There is thus obtained a two-color image. According to this system, contact between the color former and the color developer is surely prevented at room temperature, because the color former component is incorporated into microcapsules. Therefore, undesired color formation due to fog at room temperature does not occur at all.

The above description is concerned with the example wherein each of the two color formers is independently encapsulized. Components to be encapsulized can be selected depending on the particular combination of color formers and colors developers used. Specific selection would become apparent through the details hereinafter given.

Furthermore, the temperature at which color formation starts can be set not only by changing melting points or eutectic points of color formers or color developers as is conventionally known but also by optionally selecting a temperature at which the microcapsule wall becomes permeable to the prescribed component by the method hereinafter described. Hence, two or more colors can be formed by appropriately setting a plurality of heating temperatures and the timing for light irradiation.

Preferred but non-limiting embodiments in accordance with the present invention are listed below:

(1) A system essentially containing a diazo compound, a coupling component, an acidic leuco dye and a basic substance, with the diazo compound being encapsulized.

(2) The system containing the same essential components as in (1) above, wherein the diazo compound and the acid leuco dye are separately encapsulized.

(3) The system as in (1) above, wherein two or more diazo compounds which develop different colors are separately encapsulized in microcapsules whose walls are different in the temperature at which color formation starts.

(4) The system as in (2) above, wherein two or more acid leuco dyes which develop different colors are separately encapsulized into microcapsules whose walls are different in the temperature at which color formation starts.

(5) The system as in (2) above, wherein two or more diazo compounds and two or more acid leuco dyes which develop different colors are separately encapsulized into microcapsules whose walls are different in the temperature at which color formation starts.

(6) A system essentially containing a diazo compound, a coupling component, a basic substance, a basic leuco dye and a basic color developer, with the diazo compound and the basic substance being encapsulized in the same microcapsules.

(7) A system containing the same essential components as in (6) above, wherein the diazo compound is encapsulized, and a layer containing said diazo compound and the basic substance and a layer containing the basic leuco dye and the acidic color developer are separately formed.

(8) A system essentially containing a diazo compound, a coupling component, a basic leuco dye and an acidic color developer, said coupling component being basic and said diazo compound being encapsulized.

(9) A system as in (6) above, wherein the basic leuco dye is separately encapsulized.

(10) A system as in (7) above, wherein the basic leuco dye is separately encapsulized.

(11) A system as in (8) above, wherein the basic leuco dye is separatey encapsulized.

(12) A system containing the same essential components as in (1) above, wherein the coupling component is encapsulized.

(13) A system essentially containing a diazo compound, a coupling component, a basic substance, a basic leuco dye and an acidic color developer, wherein the basic leuco dye is encapsulized in microcapsules (A), the diazo compound and the basic substance are encapsulized in microcapsules (B) and the basic substance is encapsulized in microcapsules (C), said microcapsules (A), (B) and (C) having glass transition temperatures of (A)<(B)<(C).

(14) A system essentially containing a diazo compound, a coupling component, a basic substance, an acid leuco dye and an acidic substance, wherein the acid leuco dye is encapsulized in microcapsules (A), the diazo compound is encapsulized in microcapsules (B) and the acidic substance is encapsulized in microcapsules (C), said microcapsules (A), (B) and (C) having glass transition temperatures of (A)<(B)<(C).

In the above-described embodiments (13) and (14), the microcapsules (C) act on the microcapsules (A) as a decoloring agent. In these embodiments, after the diazo compound is reacted to develop a color, any unreacted diazo compound may be subjected to photolysis so as to prevent it from further developing a color at a temperature at which the decoloring agent in the microcapsules (C) functions.

The diazo compound, that is one of the essential components of the present invention, is capable of reacting with a color developer called a coupling component to develop a desired hue and is decomposable upon irradiation of light having a specific wavelength before reaction to lose its color forming capability even when reacted with the coupling component. The hue developed in this color formation system is predominantly decided by the diazo dye formed by the reaction between the diazo compound and the coupling component. Therefore, as is well known, the hue to be developed can easily be altered by changing a chemical structure of the diazo compound or the coupling component, and virtually any desired hue can be obtained by appropriately combining these techniques. To this effect, a layer having dispersed therein various diazo compounds may further contain one coupling component and other additives. In this case, each color forming unit comprises a different diazo compound, a coupling component common to the plural diazo compounds and other additives. It is also possible that different coupling components are independently dispersed in separate layers and a diazo compound common to these coupling components and other additives are incorporated in each of the layers. In this latter case, each color forming unit comprises a different coupling component, a common diazo compound and additives. In either case, color formation units comprise a combination of at least one diazo compound, at least one coupling component and additives, each of the units developing a different color.

The photolyzable diazo compound which can be used in the present invention mainly include aromatic diazo compounds, specifically including aromatic diazonium salts, diazosulfonate compounds, diazoamino compounds, and the like. In the following, description is given particularly with reference to diazonium salts.

It is generally said that the photolytic wavelengths of diazonium salts are consistent with their maximum absorption wavelengths. Further, it is known that the maximum absorption wavelengths of diazonium salts vary between about 200 nm and about 700 nm, depending on their chemical structures, as described in T. Tsunoda et al., *Kankosei Diazonium-en no Kobunkai to Kagaku Kozo* (Photolysis and Chemical Structure of Photosensitive Diazonium salts), Nippon Shashin Gakkaishi, Vol. 29 (4), pp. 197–205 (1965). More specifically, a diazonium salt used as a photolyzable compound is decomposed by light having a specific wavelength inherent to its chemical structure, and change of its chemical structure results in change of a hue of the dye produced by the coupling reaction with the same coupling component. For these reasons, diazonium salts are preferably used in the present invention.

Diazonium salts are compounds represented by the formula:

$$ArN_2^+X^-$$

wherein Ar represents a substituted or unsubstituted aromatic moiety; $N_2^+$ represents a diazonuim group; and $X^-$ represents an acid anion.

In the present invention, it is preferable to use diazonium compounds having different photolytic wavelengths. Compounds having a photolytic wavelength in the vicinity of 400 nm include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, and the like. Compounds having a photolytic wavelength between 300 nm and 370 nm include 1-diazo-4-(N,N-dioctylcarbamoyl)benzene, 1-diazo-2-octadecyloxybenzene, 1-diazo-4-(4-t-octylphenoxy)-benzene, 1-diazo-4-(2,4-di-t-amlphenoxy)benzene, 1-diazo-2-(4-t-octylphenoxy)benzene, 1-diazo-5-chloro-2-(4-t-octylphenoxy)benzene, 1-diazo-2,5-bis-octadecyloxybenzene, 1-diazo-2,4-bis-octadecyloxybenzene, 1-diazo-4-(N-octyllauroylamino)benzene, and the like. The photolytic wavelength of the aromatic diazonium compounds exemplified by the above-enumerated specific compounds can be widely varied by arbitrarily replacing their substituents.

Specific examples of the acid anion include $C_nF_{2n+1}COO^-$ (n is an integer of from 3 to 9), $C_mF_{2m+1}SO_3^-$ (m is an integer of from 2 to 8), $(ClF_{2l+1}SO_2)_2CH^-$ (l is an integer of from 1 to 18),

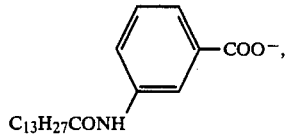

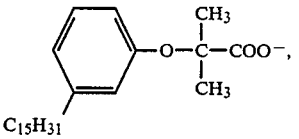

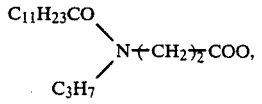

-continued

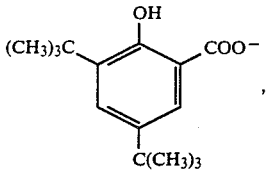

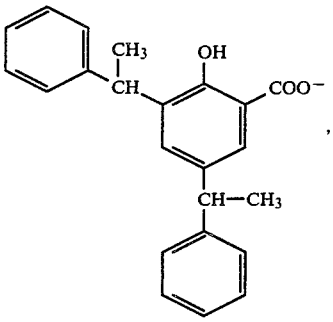

$BF_4^-$, $PF_6^-$, and the like.

Specific examples of the diazo compounds, particularly diazonium salts, are shown below:

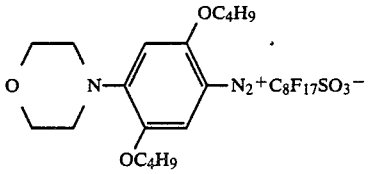

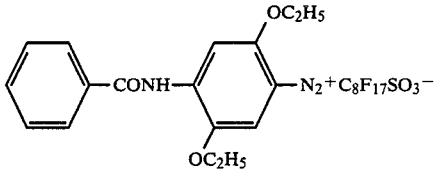

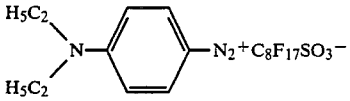

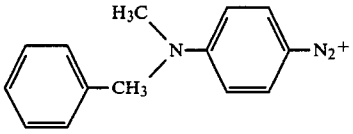

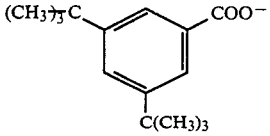

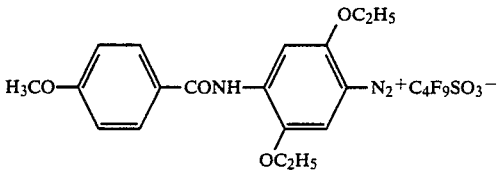

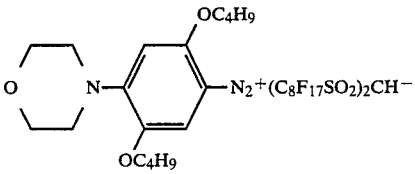

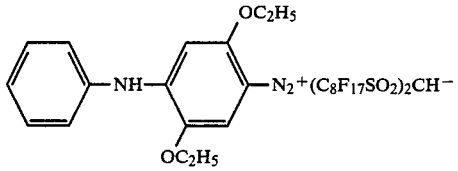

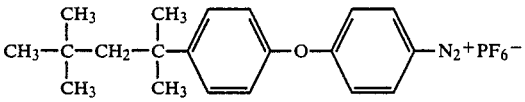

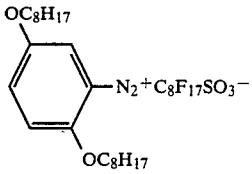

The diazosulfonate compounds which can be used in the present invention are represented by the formula

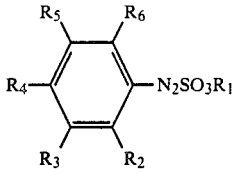

where $R_1$ represents an alkali metal or an ammonium compound residue; $R_2$, $R_3$, $R_5$ and $R_6$ each represents a hydrogen atom, a halogen atom, an alkyl group or an alkoxy group; and $R_4$ represents a hydrogen atom, a halogen atom, an alkyl group, an amino group, a benzoylamido group, a morpholino group, a trimercapto group or a pyrrolidino group.

Many examples of such diazosulfonate compounds are known, and can be obtained by treating the corresponding diazonium salts with sulfites.

Preferred among these diazosulfonate compounds are benzenediazosulfonates having substituents, e.g., 2-methoxy, 2-phenoxy, 2-methoxy-4-phenoxy, 2,4-dimethoxy, 2-methyl-4-methoxy, 2,4-dimethyl, 2,4,6-trimethyl, 4-phenyl, 4-phenoxy, 4-acetamido, 4-(N-ethyl-N-benzylamino), 4-(N,N-dimethylamino), 4-(N,N-diethylamino), 4-(N,N-diethylamino)-3-chloro, 4-pyrrolidino-3-chloro, 4-morpholino-2-methoxy, 4-(4'-methoxybenzoylamino)-2,5-dibutoxy and 4-(4'-trimercapto)-2,5-dimethoxy groups, etc. When these diazosulfonate compounds are employed, it is desirable to activate them by light irradiation prior to heat recording.

The diazoamino compounds which can be used in the present invention are compounds having the diazo group thereof coupled with dicyandiamide, sarcosine, methyltaurine, N-ethylanthranic acid, monoethanolamine, diethanolamine, guanidine, etc.

The coupling components that are color developers for the diazo compounds include, for example, compounds capable of coupling with the diazo compounds (diazonium salts) in a basic atmosphere to form a dye. Specific examples of the coupling components are resorcin, phloroglucin, sodium 2,3-dihydroxynaphthalene-6-sulfonate 1-hydroxy-2-naphthoic acid morpholinopropylamide, 1,5-dihydroxynaphthalene, 2,3-dihydroxynaphthalene, 2,3-dihydroxy-6-sulfanilnaphthalene, 2-hydroxy-3-naphthoic acid morpholinopropylamide, 2-hydroxy-3-naphthoic acid anilide, 2-hydroxy-3-naphthoic acid-2'-methylanilide, 2-hydroxy-3-naphthoic acid ethanolamide, 2-hydroxy-3-naphthoic acid octylamide, 2-hydroxy-3-naphthoic acid N-dodecyloxypropylamide, 2-hydroxy-3-naphthoic acid tetradecylamide, acetanilide, acetoacetanilide, benzoylacetanilide, 1-phenyl-3-methyl-5-pyrazolone, 1-(2',4',6'-trichlorophenyl)-3-benzamido-5-pyrazolone, 1-(2',4',6'-trichlorophenyl)-3-anilino-6-pyrazolone, 1-phenyl-3-phenylacetamido-5-pyrazolone, 1-hydroxy-2-naphthoic acid morpholinopropylamide, 2-hydroxy-3-naphthoic acid morpholinopropylamide, and the like. These coupling components may be used in combinations of two or more thereof to obtain an image of an optional tone. Since the coupling reaction between the diazo compound and the coupling component readily takes place in a basic atmosphere, a basic substance may be incorporated in a heat-sensitive recording layer.

Basic substances which can be used include sparingly water-soluble or water-insoluble basic substances and substances capable of generating an alkali upon heating, such as inorganic and organic ammonium salts, organic amines, amides, urea or thiourea and derivatives thereof, and other nitrogen-containing compounds, e.g., thiazoles, pyrroles, pyrimidines, piperazines, guanidines, indoles, imidazoles, imidazolines, triazoles, morpholines, piperidines, amidines, formazines, pyridines, etc. Specific examples of such basic substances are ammonium acetate, tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5,-trifuryl-2-imidazoline, 1,2-diphenyl-4,4-dimethyl-2-imidazoline, 2-phenyl-2-imidazoline, 1,2,3-triphenylguanidine, 1,2-ditolylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-amino-benzothiazole, 2-benzoylhydrazino-benzothiazole, and the like. These basic substances may be used in combination of two or more thereof.

The essential color-forming component that is not substantially decomposed with light will be described below.

Color formers that are not substantially decomposed with light include basic leuco dyes and acid leuco dyes that are conventionally employed in conventional heat-sensitive recording materials. The basic leuco dyes are not particularly restricted as long as they denote electrons or accept protons of an acid to develop a color. Usually, compounds that are substantially colorless and have a partial skeleton of lactones, lactams, sultones, spiropyrans, esters, amides, etc. that is ring-opened or cleaved upon contact with a color developer, can be used. Specific but nonlimiting examples of such compounds are Crystal Violet Lactone, 3-indolino-3-p-diemthylaminophenyl-6-dimethylaminophthalide, 3-diethylamino-7-chlorofluoran, 3-diethylamino-7-cyclohexylaminofluoran, 3-diethylamino-5-methyl-7-t-butylfluoran, 3-diethylamino-6-methyl-7-anilinofluoran, 3-diethylamino-6-methyl-7-p-butylanilinofluoran, 2-(N-phenyl-N-ethyl)aminofluoran, 3-diethylamino-7-dibenzylaminofluoran, 3-cyclohexylamino-6-chlorofluoran, 3-diethylamino-6-methyl-7-exylidinofluoran, 2-anilino-3-methyl-6-(N-ethyl-p-toluidino)fluoran, 3-pyrrolidino-6-methyl-7-anilinofluoran, 3-pyrrolidino-6-methyl-7-cyclohexylaminofluoran, 3-pyperidino-6-methyl-7-toluidinofluoran, 3-pyrrolidino-6-methyl-7-(p-toluidino)fluoran, 3-piperidino-6-methyl-7-toluidinofluoran, 3-pyrrolidino-6-methyl-7-(p-toluidino)fluoran, 3-piperidino-6-methyl-7-anilinofluoran, 3-N-methylcyclohexylamino-6-methyl-7-anilinofluoran, 3-diethylamino-7-(m-trifluoromethylanilino)fluoran, etc.

Color developers for these color formers include phenolic compounds, organic acid and metal salts thereof, hydroxybenzoic esters, and the like. In particular, sparingly water-soluble phenolic compounds and organic acids having a melting point of from 50° to 250° C., and more preferably from 60° to 200° C., are preferred.

Specific examples of the phenolic compounds are 4,4'-isopropylidenediphenol (bisphenol A), p-t-butylphenol, 2,4-dinitrophenol, 3,4-dichlorophenol, 4,4'-methylenebis(2,6-di-t-butylphenol), p-phenylphenol, 4,4-cyclohexylidenediphenol, 2,2'-methylenebis(4-t-butylphenol), 2,2'-methylenebis(α-phenyl-p-cresol)thiodiphenol, 4,4'-thiobis(6-t-butyl-m-cresol), sulfonyldiphenol, 1,1-bis(4-hydroxyphenyl)-n-dodecane, ethyl 4,4-bis(4-hydroxyphenyl)-1-pentanoate and, in addition, a p-t-butylphenol-formalin condensate, a p-phenylphenol-formalin condensate, and the like.

Specific examples of the organic acids and metal salts thereof are 3-t-butylsalicyclic acid, 3,5-di-t-butylsalicyclic acid, 5-α-methylbenzylsalicyclic acid, 3,5-di-α-methylbenzylsalicyclic acid, 3-t-octylsalicyclic acid, 5-α,γ-dimethyl-α-phenyl-γ-phenylpropylsalicyclic acid, etc. and zinc salts, lead salts, aluminum salts, magnesium salts and nickel salts of these acids.

Specific examples of the hydroxybenzoic esters include ethyl p-hydroxybenzoate, butyl p-hydroxybenzoate, heptyl p-hydroxybenzoate, benzyl p-hydroxybenzoate, and the like.

The acid leuco dyes which can be used as color formers in the present invention include compounds, such as pH-indicators. Specific but nonlimiting examples thereof are phenolphthalein, fluoresceine, 2',4',5',7'-tetrabromo-3,4,5,6-tetrachlorofluoresceine, Tetrabromophenol Blue, 4,5,6,7-tetrabromophenolphthalein, Eosine, Aurin Cresol Red, 2-naphtholphenolphthalein, and the like.

Color developers reactive with these acid leuco dyes to form a color are basic substances or substances that produce an alkali by heating. Any of the aforesaid basic substances can preferably be employed.

Microcapsules which can be used in the present invention function to prevent reactive substances present inside and outside the capsules from contacting each other by the partitioning wall at room temperature but become permeable to the reactive substances only when heated to a certain temperature. This function is a novel concept recently developed and realized by the present inventors. It has been elucidated that the temperature at which permeation starts can be optionally controlled by appropriately selecting the capsule wall materials, capsule core materials and additives and that this temperature corresponds to a glass transition temperature of the capsule wall, and thus the present invention has been achieved.

Control on glass transition temperature inherent to the capsule wall can be embodied by altering the kind of capsule wall-forming materials. Particularly preferred microcapsules include capsules made of polyurea or polyurethane, polyurea/urethane mixed capsules, urea-formalin capsules, polyurea or polyurethane/other synthetic resin mixed capsules in which a complete synthetic resin is incorporated within the capsules as a core material, capsules made of polyester or polyamide, and the like.

The microcapsules to be used in the present invention can be prepared by emulsifying core materials and forming a wall of a high polymer around the oil droplets. Reactants for forming the high polymer are added to the inside and/or outside of the oil droplets. Examples of the high polymer to be formed are polyurethane, polyurea, polyamide, polyester, polycarbonate, an urea-formaldehyde resin, a melamine resin, polystyrene, a styrene-methacrylate copolymer, a styrene-acrylate copolymer, and the like.

In the present invention, it is effective to adopt an encapsulization process comprising polymerization of reactants supplied from the inside of the oil droplets. In other words, this process can provide excellent microcapsules suitable for recording materials as having a uniform particle size and a long working life.

Details for the above-described encapsulization process and examples of compounds to be used therein are described in U.S. Pat. Nos. 3,726,804 and 3,796,669.

Taking the case of using polyurea or polyurethane as a capsule wall material for instance, a polyisocyanate and a second component capable of reacting therewith to form a capsule wall, e.g., polyols and polyamines, are mixed in an aqueous phase or an oily liquid to be encapsulized and the mixture is emulsified or dispersed in water. Then, elevation of the temperature causes polymerization at the interface of the oil droplets to form microcapsules. In the above case, an auxiliary solvent having a low boiling point and a strong dissolving power may be added to the oil liquid to be encapsulized. Polyurea may be formed without the aforesaid second component.

The polyisocyanates and the polyols or polyamines reactive therewith which can be used in the above-described encapsulization are disclosed in U.S. Pat. Nos. 3,281,383, 3,773,695 and 3,793,268, Japanese Patent Publication Nos. 40347/73 and 24159/74 and Japanese Patent Application (OPI) Nos. 80191/73 and 84086/73.

For the purpose of accelerating the urethanation, a tin salt, etc. may be used in combination.

It is possible to widely vary a glass transition temperature of the wall by appropriately selecting the first wall-forming component, i.e., polyisocyanates, and the second wall-forming component, i.e., polyols or polyamines.

In the particular cases of using polyurea or polyurethane capsules, the glass transition temperature of "the system" can be varied by adding a glass transition temperature-controlling agent, e.g., urea compounds, fatty acid amides, hydroxyl compounds as described in Japanese Patent Application No. 59230/84, carbamic esters, aromatic methoxy compounds, organic sulfonamide compounds as described in Japanese Patent Application No. 206832/84, etc., in a solid-dispersed state. Such a controlling agent is generally added in an amount of from 0.1 to 10 parts by weight per part by weight of capsules.

The glass transition temperature of the capsule wall per se or of "the system" inclusive of the mutual action of the capsule wall per se and the glass transition temperature-controlling agent is a peak temperature of Tan $\delta$ as measured by the use of VIBRON (DDV-III, manufactured by Toyo Baldwin Co., Ltd.), which is obtained by dividing the dynamic elastic modulus by the storage elastic modulus.

Samples for measuring glass transition temperatures of capsule wall per se can be prepared, for example, by dissolving 20 parts by weight of a 3/1 adduct of xylylene diisocyanate and trimethylpropane as a capsule wall component in 30 parts by weight of ethyl acetate, bar-coating the solution on a polyethylene sheet, allowing the coating to react in water at from 40° C. to 60° C., peeling the coating film from the sheet, followed by air-drying at 24° C. and 64% RH (relative humidity) for one day to obtain a polyurea film having a thickness of from 10 to 20 μm. Samples for measuring glass transition temperatures of "the system" inclusive of the mutual action of a heat-melting substance and the capsule wall can be prepared by immersing the above-described polyurea film in a 20% methanolic solution of p-benzyloxyphenol for 30 hours, followed by air-drying at 24° C. and 64% RH for one day.

In the encapsulization, a water-soluble high polymer may be used as a protective colloid. Useful water-soluble high polymers include water-soluble anionic high polymers, nonionic high polymers and amphoteric high polymers. The anionic high polymers may be either natural or synthetic, and include those having a carboxyl group or a sulfo group. Specific examples of the anionic high polymers are naturally-occurring high polymers, such as gum arabic, aliginic acid, etc.; semi-synthetic products, such as carboxymethyl cellulose, phthalated gelatin, sulfated starch, sulfate cellulose, lignin sulfonic acid, etc.; and synthetic products, such as maleic anhydrode (inclusive of a hydrolysate thereof) copolymers, (meth)acrylic polymers and copolymers, vinylbenzenesulfonic acid polymers and copolymers, carboxyl-modified polyvinyl alcohol, etc.

Examples of the nonionic high polymers include polyvinyl alcohol, hydroxyethyl cellulose, methyl cellulose, and the like.

Examples of the amphoteric high polymers include gelatin and the like.

These water-soluble high polymers are used as aqueous solutions at concentrations of from 0.1 to 10% by weight.

The organic solvent that can be used as one of the core materials according to the present invention preferably has a boiling point of not lower than 180° C., since those having too a low boiling point are lost due to vaporization during preservation. Organic solvents incapable of vinyl polymerization include phosphoric esters, phthalic esters, other carboxylic acid esters, fatty acid amides, alkylated biphenyls, alkylated terphenyls, chlorinated paraffins, alkylated naphthalenes, diarylethanes, and the like. Specific examples of these organic solvents include tricresyl phosphate, trioctyl phosphate, octyldiphenyl phosphate, tricyclohexyl phosphate, cresyldiphenyl phosphate, dibutyl phthalate, dioctyl phthalate, dilauryl phthalate, dicyclohexyl phthalate, butyl oleate, diethlene glycol dibenzoate, dioctyl sebacate, dibutyl sebacate, dioctyl adipate, trioctyl trimellitate, acetyltriethyl citrate, octyl maleate, dibutyl maleate, isopropylbiphenyl, isoamylbiphenyl, diisopropylnaphthalene, 1,1'-ditolylethane, 2,4-di-t-amylphenol, N,N-dibutyl-2-butoxy-5-t-octylaniline, etc. Vinyl compounds may also be used as an organic solvent.

The above-described microcapsules may further contain any of the diazo compounds, coupling components, color formers other than the diazo compounds, color developers and basic substances either alone or in combinations. Further, two or more kinds of the diazo compounds, coupling components, basic substances, color formers other than the diazo compounds and color developers may be incorporated into the same capsules or different capsules. These components may be incorporated into capsules either dissolved or finely dispersed in the aforesaid organic solvent.

Microcapsules can be prepared from an emulsion containing not less than 0.2% by weight of the components to be encapsulized.

Amounts of the components to be used in the present invention are: generally from 0.05 to 1.5 g/m$^2$, and preferably from 0.05 to 0.8 g/m$^2$, for the basic leuco dye, acid leuco dye, or the diazo compound; generally from 0.3 to 8 g/m$^2$, and preferably from 0.5 to 5 g/m$^2$, for the color developer for the basic leuco dye or acid leuco dye or the coupling component; generally from 0.3 to 10 g/m$^2$, and preferably from 1 to 5 g/m$^2$, for the decoloring agent; and generally from 0.1 to 15 g/m$^2$, and preferably from 0.1 to 8 g/m$^2$, for the organic solvent in microcapsules. The basic substance, if added for the purpose of accelerating the color formation reaction of the diazo compound, is generally used in an amount of from 0.3 to 8 g/m$^2$, and preferably from 0.5 to 5 g/m$^2$. The decoloring agent is usually used in an amount of from 1 to 50 mols, and preferably from 5 to 30 moles, per mol of the color formation accelerator.

In the present invention, it is also possible to use a color formation aid from the purpose of increasing color density upon heat recording or reducing the lowest color developing temperature. It is considered that the color formation aid decreases melting points of the coupling components, alkalis, color formers, color developeres or diazo compounds or softening points of the capsule wall to thereby creat a condition under which the diazo compounds, alkalis, coupling components, color formers and color developers are readily reacted.

Such a color formation aid includes phenolic compounds, alcoholic compounds, amide compounds, sulfonamide compounds, and the like. Specific examples of the color formation aid are p-t-octylphenol, p-benzyloxyphenol, phenyl p-hydroxybenzoate, benzyl carbanilate, phenethyl carbanilate, hydroquinone dihydroxyethyl ether, xylylenediol, N-hydroxyethylmethanesulfonic acid amide, N-phenylmethanesulfonic acid amide, and the like. These compounds may be present either within microcapsules or outside microcapsules in the form of a dispersion.

The heat-sensitive recording materials in accordance with the present invention can contain fine powders of pigments, such as silica, barium sulfate, titanium oxide, aluminum hydroxide, zinc oxide, calcium carbonate, etc., styrene beads, or fine powders of an urea-melamine resin, and the like for the purpose of preventing sticking to a thermal head or improving writing properties.

The heat-sensitive recording materials of the present invention can further contain metal soaps in an amount of from 0.2 to 7 g/m$^2$ for the purpose of sticking prevention.

A heat-sensitive coating composition comprising the above-mentioned components is coated on a support by using an appropriate binder. The binder to be used includes various emulsions of, for example, polyvinyl alcohol, methyl cellulose, carboxymethyl cellulose, hydroxypropyl cellulose, gum arabic, gelatin, polyvinyl pyrrolidone, casein, a styrene-butadiene latex, an acrlonitrile-butadiene latex, polyvinyl acetate, a polyacrylate, an ethylene-vinyl acetate copolymer, etc. The amount of the binder to be used is from 0.5 to 5 g/m$^2$, on a solids basis.

In addition to the above-described various components, acid stabilizers, such as citric acid, tartaric acid, oxalic acid, boric acid, phosphoric acid, pyrophosphoric acid, etc., may be used.

It is advantageous that the diazo compounds, coupling components, basic substances, color formers other than the diazo compounds or color devleopers, when not encapsulized, are solid-dispersed by means of a sand mill, etc. Such being the case, each of these components can be separately dispersed in a water-soluble high polymer solution. The same water-soluble high polymers as enumerated for the encapsulization are preferably employed. In this case, the watersoluble high polymer solutions have concentrations of from 2 to 30% by weight, and the diazo compounds, coupling components, basic substances, color formers other than the diazo compounds and color developers each is poured into the solution in concentrations of from 5 to 40% by weight and dispersed therein preferably to a particle size of 10 $\mu$m or smaller.

In the production of the recording materials according to the present invention, at least one of the diazo compounds, coupling components, basic substances, color formers other than the diazo compounds and colro developers is dissolved or dispersed in an organic solvent and then encapsulized. The rest of the reactive substances are solid-dispersed or dissolved in water and mixed with the microcapsule dispersion to prepare a coating composition. The coating composition is coated on a support, such as paper and synthetic resin films, by a conventional coating technique, such as bar coating, blade coating, air knife coating, gravure coating, roll coating, spray coating, dip coating, and the like, followed by drying to form a heat-sensitive layer having a solid content of from 2.5 to 15 g/m$^2$. Alternatively, a microcapsule layer containing a reactive substance and an organic solvent and a layer containing the rest of the reactive substances are provided in lamination.

Supports which can be used in the present invention include paper to advantage. Paper supports coated with a dispersion of a pigment, e.g., calcium carbonate, kaolin, talc, alumina, etc., in polyvinyl alcohol, gelatin, carboxymethyl cellulose, hydroxyethyl cellulose, hydroxypropyl cellulose or a synthetic resin latex may also be employed.

The heat-sensitive recording materials in accordance with the present invention can be used as printer paper for facsimiles machines and electronic computers. The facsimiles and electronic computers to which the heat-sensitive recording materials are applied should have a light exposure zone for photolysis. Arrangement of a recording thermal head and an exposure zone includes two types. One of which is a so-called head-multi-scan system, in which a once recorded material is exposed to light for photolysis, and, either before or after the exposure, the material is returened to the state of waiting for recording by a running mechanism so that recording may be effected on the once recorded areas, said operation involving recording, light irradiation and returning of the material being repeated. Another type is a so-called multihead-scan system, in which a plurality of recording heads corresponding to the desired number of colors having light irradiation zones therebetween. Both of the systems may be adopted in combination. If desired, heat energy applied to a head may be varied. As a light source emitting light of a desired wavelength for photolysis, various conventional light sources are employed, including fluoroescent lamps, fluorescent lamps for the wet diazo type process, fluorescent lamps for electrostatic photography, xenon lamps, xenon flash lamps, low, intermediate, high or ultrahigh pressure mercury lamps, flash bulb for photography, strobes, etc. In order to make the light exposure zone compact, the light source zone and the exposure zone may be separated apart by using an optical fiber.

In some cases, a recording material having been once recorded may be fixed by exposure to light mainly of a visible light region by placing it under sunlight or a flurorescent lamp and then again recorded to obtain a multicolor image.

As described above, according to the present invention, the material constituting a color forming unit is encapsulized so that a reaction of necessary materials selectively takes place only when necessary, and a color former which is inactivated by light and a color former which is not inactivated by light are employed. Owing to these features, the multicolor heat-sensitive recording materials according to the present invention can provide multicolor images having excellent hues, preservability and background that have never been attained in the conventional heat-sensitive recording materials.

The present invention is now illustrated in greater detail with reference to the following examples, but it should be understood that the present invention is not deemed to be limited thereto. In these examples, all the parts, percents and ratios are by weight unless otherwise indicated.

EXAMPLE 1

Microcapsule Emulsion A

In a mixed solvent of 24 parts of diphenylethane and 5 parts of ethyl acetate were dissolved 4.8 parts of a basic leuco dye of the formula

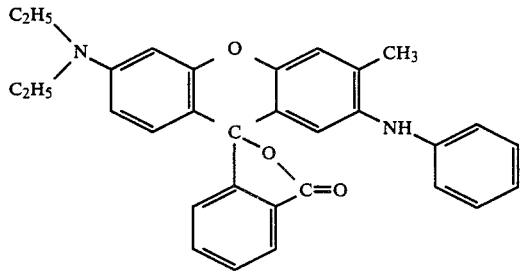

and 18 parts of a 3/1 adduct of xylyene diisocyanate and trimethylolpropane. The resulting solution was emulsified in an aqueous solution consisting of 5.2 parts of polyvinyl alcohol and 58 parts of water 20° C. to obtain an emulsion having an average particle size of 3 μm. To the emulsion was added 100 parts of water, and the mixture was heated at 60° C. for 2 hours while stirring to thereby obtain Microcapsule Emulsion A containing the basic leuco dye.

Microcapsule Emulsion B

Two parts of a diazo compound of the formula

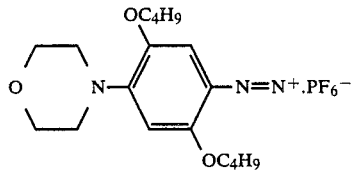

and 18 parts of a 3:1 adduct of xylyene diisocyanate and trimethylolpropane were dissolved in a mixed solvent of 24 parts of dibutyl phthalate and 5 parts of ethyl acetate. The resulting solution was emulsified in an aqueous solution of 5.2 parts of polyvinyl alcohol in 58 parts of water at 20° C. to obtain an emulsion having an average particle size of 3 μm. To the emulsion was added 100 parts of water, and the mixture was heated at 60° C. for 2 hours while stirring to obtain Microcapsule Emulsion B containing the diazo compound as a core material.

Dispersion A

Ten parts of bisphenol A were dispersed in 100 parts of a 5% polyvinyl alcohol aqueous solution for 24 hours in a sand mill to obtain Dispersion A of bisphenol having an average particle size of 3 μm.

Dispersion B

Ten parts of a compound of the formula

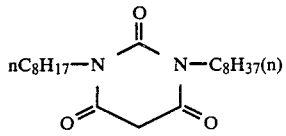

were dispersed in 100 parts of a 5% polyvinyl alcohol aqueous solution in a sand mill for about 24 hours to obtain Dispersion B of a red-forming coupling component having an average particle size of 3 μm.

Dispersion C

Ten parts of 1,2-dicyclohexyl-3-phenylguanidine were dispersed in 100 parts of a 5% polyvinyl alcohol aqueous solution in a sand mill for about 24 hours to obtain Dispersion C of 1,2,3-triphenylguanidine having an average particle size of 3 μm.

Dispersion D

Ten parts of p-benzyloxyphenol were dispersed in 100 parts of a 5% polyvinyl alcohol aqueous solution in a sand mill for about 24 hours to obtain Dispersion D of p-benzyloxyphenol having an average particle size of 3 μm.

Coating Composition A was prepared by mixing 25 parts of Microcapsule Emulsion A, 15 parts of Dispersion A and 15 parts of Dispersion D.

Coating Composition B was prepared by mixing 30 parts of Microcapsule Emulsion B and 20 parts of Dispersion B. Dispersion C was used as such as Coating Composition C.

Coating Composition B, C and A were coated in this order on smooth fine paper having a basis weight of 50 g/m$^2$ each to a dry coverage of 4 g/m$^2$, each followed by drying at 40° C. for 30 minutes to produce a heat-sensitive recording material. The glass transition temperature of the capsule wall in Coating Compositions A or B was found to be 90° C. or 120° C., respectively.

The thus obtained heat-sensitive recording material was heated at 100° C. (low temperature) and 130° C. (high temperature ) with heat blocks each for 1 second. There were obtained a black image on the area heated at the low temperature and a red image on the area heated at the high temperature. Thereafter, the entire surface of the recorded material was exposed to light by the use of Ricopy Superdry 100 (manufactured by Ricopy Co., Ltd.) to thereby fix the red image.

EXAMPLE 2

Fifty parts of Dispersion C were added to Coating Composition B to prepare Coating Composition B'. Coating Composition B' and Coating Composition A were coated in the order stated on smooth fine paper having a basis weight of 50 g/m$^2$ to provide a dry coverage of 8 g/m$^2$ and 4 g/m$^2$, respectively, each followed by drying at 40° C. for 30 minutes to produce a heat-sensitive recording material. The glass transition temperature of the microcapsule wall in Coating Composition A or B' was found to be 90° C. or 120° C., respectively.

The thus produced heat-sensitive recording material was heat-recorded in the same manner as in Example 1 to obtain a black image on the area heated at the low temperature and a red image on the area heated at the high temperature. Thereafter, the entire surface of the recorded material was exposed to light emitted from Ricopy Superdry 100 to fix the red image.

EXAMPLE 3

In a mixed solvent of 24 parts of diphenylethane and 5 parts of ethyl acetate were dissolved 4.8 parts of the same basic leuco dye as used in Example 1 and 18 parts of a 3/1 adduct of xylylene diisocyanate and trimethylolpropane. The resulting solution was mixed with an aqueous solution of 3.5 parts of polyvinyl alcohol, 1.7 parts of gelatin and 2.4 parts of 1,4-di(hydroxyethoxy)-benzene in 58 parts of water, and the mixture was emulsified at 20° C. to obtain an emulsion having an average particle size of 3 μm. To the emulsion was added 100 parts of water, and the mixture was heated at 60° C. for 2 hours while stirring to obtain Microcapsule Emulsion A' containing the basic leuco dye as a core material. Coating Composition A' was prepared by mixing 25 parts of Microcapsule Emulsion A', 15 parts of Dispersion A as prepared in Example 1 and 15 parts of 5% polyvinyl alcohol. Coating Compositions B and C as prepared in Example 1 and Coating Composition A' were coated in the order stated on smooth fine paper having a basis weight of 50 g/m$^2$ each to a dry coverage of 4 g/m$^2$, each followed by drying at 40° C. for 30 minutes to obtain a heat-sensitive recording material. The glass transition temperature of the microcapsule wall in Coating Compositions A' or B was found to be 90° C. and 120° C., respectively.

The thus produced sample was subjected to heat recording in the same manner as in Example 1. There were obtained a black image on the area heated at the low temperature and a red image on the area heated at the high temperature. Thereafter, the entire surface of the recorded material was exposed to light by the use of Ricopy Superdry 100 to fix the red image.

COMPARATIVE EXAMPLE

In 100 parts of a 5% polyvinyl alcohol aqueous solution was dispersed 2.4 parts of the same basic leuco dye as used in Example 1 in a sand mill for 24 hours to obtain Dispersion E having an average particle size of 3 μm. Coating Composition D was prepared by mixing 25 parts of Dispersion E and 15 parts each of Dispersions A and D as prepared in Example 1. Then, 2.4 parts of phenolphthalein was dispersed in 100 parts of a 5% polyvinyl alcohol aqueous solution in a sand mill for 24 hours to obtain Dispersion F having an average particle size of 3 μm. Dispersion F was used as Coating Composition E. Coating Compositions E, C (as prepared in Example 1) and D were coated in this order on smooth fine paper having a basis weight of 50 g/m$^2$ each to a dry coverage of 4 g/m$^2$, each followed by drying at 40° C. for 30 minutes to obtain a heat-sensitive recording material. The resulting heat-sensitive recording material was heat-recorded in the same manner as in Example 1 to obtain a black image on the areas heated at 100° C. and a red image on the areas heated at 130° C.

Heat recording was carried out on each of the heat-sensitive recording materials produced in Examples 1 to 3 and Comparative Example by means of a GII mode heat-sensitive printer (Panafax 7200, manufactured by Matsushita Denso Co., Ltd.).

In order to evaluate working preservability, the heat-sensitive recording material was subjected to accelerated deterioration test at 40° C. and 90% RH for 1 day, and then heat recording was carried out.

Resistance against contact with diazo type paper after copying was evaluated by contacting the heat-sensitive recording material with diazo type paper immediately after copying for 3 hours and determining an increase in fog on the background.

Resistance to light was evaluated by exposing the heat-sensitive recording material to sunlight for 8 hours and observing color disappearance of the recorded area and an increase in fog on the background.

Solvent resistance was evaluated by applying Cemedyne (produced by Cemedine Co., Ltd.) to the surface of the recording material and observing fog.

Abrasive resistance was evaluated by scratching the surface of the recording material with a nail to observe color development.

The results of these tests are shown in Table 1 below.

TABLE 1

| Example No. | Fog | Black Density | Fog After Accelerated Deterioation | Contact Fog with Diazo Paper | Exposure to Sunlight: Color Dis-appearance | Exposure to Sunlight: Fog | Fog by Solvent | Abrasive Fog |
|---|---|---|---|---|---|---|---|---|
| Example | | | | | | | | |
| 1 | 0.06 | 1.22 | 0.13 | A | A | A | A | A |
| 2 | 0.08 | 1.17 | 0.10 | A | A | A | A | A |

TABLE 1-continued

| Example No. | Fog | Black Density | Fog After Accelerated Deterioation | Contact Fog with Diazo Paper | Exposure to Sunlight Color Dis-appearance | Exposure to Sunlight Fog | Fog by Solvent | Abrasive Fog |
|---|---|---|---|---|---|---|---|---|
| 3 | 0.06 | 1.11 | 0.07 | A | A | A | A | A |
| Comparative Example | | | | | | | | |
| | 0.21 | 1.16 | 0.41 | C | C | C | C | C |

Note:
A: No change
B: Slight changes but practically useful
C: Marked changes and practically not useful As can be seen from Table 1 above, the heat-sensitive recording materials according to the present invention undergo less fog, provide high color densities, exhibit excellent preservability and undergo less fog when contacted with diazo type paper. Further, they are substantially free from color disappearance or background fog due to exposure to sunlight, fog due to application of Cemedyne, and color development due to scratches with a nail.

EXAMPLE 4

Microcapsule Emulsion C

Diazo compound of the formula: 3.4 parts

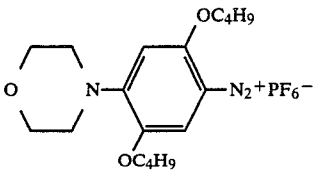

| | |
|---|---|
| Tricresyl phosphate | 6 parts |
| Methylene chloride | 12 parts |
| Trimethylolpropane trimethacrylate | 18 parts |
| Takenate D-110N (Adduct of trimethylolpropane-trixylylene diisocyanate of the formula: | 24 parts |

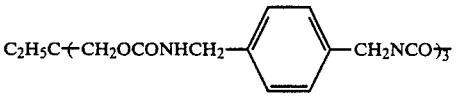

(75 wt % and ethyl acetate 25 wt %)

The above components were mixed and added to a mixture of 63 parts of a 8% polyvinyl alcohol aqueous solution and 100 parts of distilled water. The mixture was dispersed and emulsified at 20° C. to obtain an emulsion having an average particle size of 2 μm. The resulting emulsion was stirred at 40° C. for 3 hours. After cooling to 20° C., 100 cc of Amberlite IR-120B (produced by Rohm & Haas Co.) was added thereto, followed by stirring for 1 hour. Filtration gave Microcapsule Emulsion C.

Microcapsule Emulsion D

| | |
|---|---|
| Phenolphthalein | 4.8 parts |
| Diphenylmethane | 24 parts |
| Ethyl acetate | 5 parts |
| Takenate D-110N | 24 parts |

The above components were mixed and added to a mixture of 63 parts of a 8% polyvinyl alcohol aqueous solution and 100 parts of distilled water, followed by emulsifying at 20° C. to obtain an emulsion having an average particle size of 2 μm. The resulting emulsion was stirred at 40° C. for 3 hours to obtain Microcapsule Emulsion D.

Microcapsule Emulsion E

In a mixed solvent of 24 parts of diphenylethane and 5 parts of ethyl acetate were dissolved 4.8 parts of a basic leuco dye of the formula

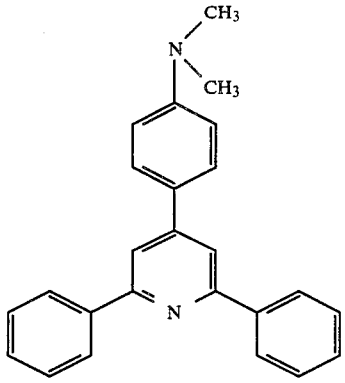

and 18 parts of a 3/1 adduct of xylylene diisocyanate and trimethylolpropane. The resulting solution was mixed with an aqueous solution of 5.2 parts of polyvinyl alcohol in 58 parts of water and emulsified therein to obtain an emulsion having an average particle size of 3 μm. To the emulsion was added 100 parts of water, and the mixture was heated at 60° C. for 2 hours while stirring to obtain Microcapsule Emulsion E containing the basic leuco dye as a core material.

Dispersion G

Ten parts of a compound of the formula:

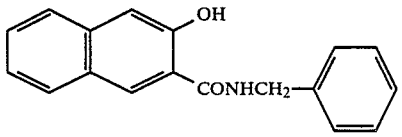

were added to 100 parts of a 5% polyvinyl alcohol aqueous solution, and the mixture was dispersed in a sand mill for about 24 hours to obtain Dispersion G of a blue-forming coupling component having an average particle size of 3 μm.

Dispersion H

Ten parts of 1,2-dicyclohexyl-3-phenylguanidine were added to 100 parts of a 5% polyvinyl alcohol aqueous solution, and the mixture was dispersed in a sand mill for about 24 hours to obtain Dispersion H of 1,2,3-triphenylguanidine having an average particle size of 3 μm.

Dispersion I

Ten parts of p-benzyloxyphenol were added to 100 parts of a 5% polyvinyl alcohol aqueous solution. and the mixture was dispersed in a sand mill for about 24 hours to obtain Dispersion I of p-benzyloxyphenol having an average particle size of 3 μm.

Dispersion J

Ten parts of bisphenol A were added to 100 parts of a 5% polyvinyl alcohol aqueous solution, and the mixture was dispersed in a sand mill for about 24 hours to obtain Dispersion J of bisphenol A having an average particle size of 3 μm.

Recording Paper A

Coating Composition F was prepared by mixing 30 parts of Microcapsule Emulsion C, 25 parts of Microcapsule Emulsion D, 20 parts of Dispersion G, 50 parts of Dispersion H and 25 parts of Dispersion I. Coating Composition F was coated on smooth fine paper having a basis weight of 50 g/m$^2$ to a dry coverage of 12 g/m$^2$ and dried at 40° C. for 30 minutes to produce Recording Paper A. Recording Paper A was heated at 100° C. for 1 second by the use of a heat block to obtain a bluish purple image having a reflection density of 1.2.

Thereafter, Recording Paper A was irradiated with light having a wavelength of from 400 to 430 nm for 10 seconds by the use of Ricopy Superdry 100. When a heat block was pressed thereonto for 1 second in the same manner as above, there was developed a red color having a reflection density (OD) of 0.8.

As described above, recording before light irradiation results in development of a bluish purple color, and recording on the same recording material after photolysis of the diazo compound results in development of a red color. These color images are free from color smearing, and no mixing of the blue color into the red color was observed.

Recording Paper B

Coating Composition G was prepared by mixing 30 parts of Microcapsule Emulsion C, 50 parts of Dispersion H and 20 parts of Dispersion G. Coating Composition H was prepared by mixing 25 parts of Microcapsule Emulsion E and 15 parts of Dispersion J. Dispersion I was used as such as Coating Composition I.

Coating Compositions H, I and G were coated in the order stated on smooth fine paper, each to a dry coverage of 4 g/m$^2$, each followed by drying at 40° C. for 30 minutes to obtain Recording Paper B. The thus obtained recording paper was heated at 130° C. for 1 second with a heat block to obtain a green image. After light irradiation in the same manner as for Recording Paper A, Recording Paper B was again recorded with a heat block in the same manner as above to obtain a clear yellow image.

Each of Recording Papers A and B was determined for working preservability, resistance to contact with diazo type paper after copying, light resistance, solvent resistance and abrasion resistance in the same manner as described in Examples 1 to 3.

As a result, neither of Recording Papers A and B underwent any change in performance after the accelerated deterioration test, which indicates extremely hgh resistance to deterioration.

While the invention has been described in detail and with reference to specific embodiments thereof, it will be apparent to one skilled in the art that various changes and modifications can be made therein without departing from the spirit and scope thereof.

What is claimed is:

1. A multicolor heat-sensitive recording material comprising a support having carried thereon at least two colorless or light-colored color formers capable of developing different colors, and color developers capable of reacting with said color formers upon heating to develop colors, wherein the color formers are encapsulated in heat sensitive capsules, at least one of the color formers is a diazo compound which is substantially decomposed by light, and at least one of the other color formers is a compound which is not substantially decomposed by light.

2. A multicolor heat-sensitive recording material as in claim 1, wherein the color former which is not substantially decomposed with light is an acid leuco dye and the color developer capable of reacting therewith is a basic substance.

3. A multicolor heat-sensitive recording material as in claim 2, wherein the material further contains an acidic substance as a decoloring agent, said acidic substance being encapsulized into microcapsules having a microcapsule wall that has a glass transition temperature higher than the temperature at which said diazo compound and said acid leuco dye develop colors.

4. A multicolor heat-sensitive recording material as in claim 2, wherein the diazo compound and the acid leuco dyes are separately encapsulized.

5. A multicolor heat-sensitive recording material as in claim 4, wherein two or more acid leuco dyes which develop different colors are separately encapsulized into microcapsules whose walls are different in the temperature at which color formation starts.

6. A multicolor heat-sensitive recording material as in claim 2, comprising two or more diazo compound which develop different colors separately encapsulized in microcapsules whose walls are different in the temperature at which color formation starts.

7. A multicolor heat-sensitive recording material as in claim 2, wherein two or more diazo compounds and two or more acid leuco dyes which develop different colors are separately encapsulized into microcapsules whose walls are different in the temperature at which color formation starts.

8. A multicolor heat-sensitive recording material as in claim 1, wherein the color former which is not substantially decomposed by light is a basic leuco dye and the color developer capable of reacting therewith is an acidic substance.

9. A multicolor heat-sensitive recording material as in claim 8, wherein the material further contains a basic substance as a decoloring agent, said basic substance being encapsulized into microcapsules having a microcapsule wall that has a glass transition temperature higher than the temperature at which said diazo compound and said basic leuco dye develop colors.

10. A multicolor heat-sensitive recording material as in claim 8, wherein the diazo compound is encapsulized, and a layer containing said diazo compound and the basic substance and a layer containing the basic leuco dye and the acidic color developer are separately formed.

11. A multicolor heat-sensitive recording material as in claim 1, wherein said diazo compound is present in an amount of from 0.05 to 1.5 g/m$^2$, the color developer capable of reacting with the diazo compound is present in an amount of from 0.3 to 8 g/m$^2$, said color former which is not substantially decomposed by light is present in an amount of from 0.05 to 1.5 g/m$^2$, and the color developer capable of reacting with the color former which is not substantially decomposed by light is present in an amount of from 0.3 to 8 g/m$^2$.

12. A multicolor heat-sensitive recording material as in claim 11, wherein the color former which is not substantially decomposed with light is an acid leuco dye and the color developer capable of reacting therewith is a basic substance.

13. A multicolor heat-sensitive recording material as in claim 12, wherein the material further contains an acidic substance as a decoloring agent, said acidic substance being encapsulized into microcapsules having a microcapsule wall that has a glass transition temperature higher than the temperature at which said diazo compound and said acid leuco dye develop colors.

14. A multicolor heat-sensitive recording material as in claim 13, wherein the decoloring agent is present in an amount of from 0.3 to 10 g/m$^2$.

15. A multicolor heat-sensitive recording material as in claim 13, wherein the decoloring agent is present in an amount of from 1 to 5 g/m$^2$.

16. A multicolor heat-sensitive recording material as in claim 1, wherein said diazo compound is present in an amount of from 0.5 to 0.8 g/m$^2$, the color developer capable of reacting with the diazo compound is present in an amount of from 0.5 to 5 g/m$^2$, said color former which is not substantially decomposed by light is present in an amount of from 0.5 to 0.8 g/m$^2$, and the color developer capable of reacting with the color former which is not substantially decomposed by light is present in an amount of from 0.5 to 5 g/m$^2$.

17. A multicolor heat-sensitive recording material as in claim 1, wherein the material further contains a basic substance.

18. A multicolor heat-sensitive recording material as in claim 17, wherein said basic substance is present in an amount of from 0.3 to 8 g/m$^2$.

19. A multicolor heat-sensitive recording material as in claim 17, wherein said basic substance is present in an amount of from 0.5 to 5 g/m$^2$.

20. A multi-color heat sensitive recording material as in claim 1, wherein the glass transition temperature of the capsule wall containing at least one of the color formers or color developers is 90° C. or greater.

21. A multi-color heat sensitive recording material as in claim 1, wherein at least two reactive components are microencapsulated, and the glass transition temperature of at least one of the microcapsules is approximately 30° C. greater than one of the others.

* * * * *